US010912442B2

(12) United States Patent
Sankaran Veerabhagu et al.

(10) Patent No.: US 10,912,442 B2
(45) Date of Patent: Feb. 9, 2021

(54) DRYING SYSTEMS AND METHODS INCLUDING MULTI-DIRECTIONAL AIR DISTRIBUTION FOR A DISHWASHING APPLIANCE

(71) Applicant: Haier US Appliance Solutions, Inc., Wilmington, DE (US)

(72) Inventors: Thiyagarajan Sankaran Veerabhagu, Manitowoc, WI (US); Ramasamy Thiyagarajan, Louisville, KY (US); Timothy Kopera, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 94 days.

(21) Appl. No.: 16/238,707

(22) Filed: Jan. 3, 2019

(65) Prior Publication Data

US 2020/0214537 A1 Jul. 9, 2020

(51) Int. Cl.
*A47L 15/48* (2006.01)
*F26B 21/02* (2006.01)

(52) U.S. Cl.
CPC ..... *A47L 15/486* (2013.01); *A47L 15/483* (2013.01); *A47L 15/488* (2013.01); *F26B 21/022* (2013.01); *F26B 21/026* (2013.01); *F26B 21/028* (2013.01)

(58) Field of Classification Search
CPC ..... A47L 15/486; A47L 15/48; A47L 15/488; F26B 21/022; F26B 21/026; F26B 21/028
USPC ..... 134/56 D, 57 D, 58 D; 34/487, 488, 489
See application file for complete search history.

(56) References Cited

U.S. PATENT DOCUMENTS

| | | | | |
|---|---|---|---|---|
| 7,676,954 | B2 * | 3/2010 | Classen | A47L 15/483 34/486 |
| 7,695,572 | B2 * | 4/2010 | Ahn | A47L 15/0015 134/58 D |
| 2011/0298241 | A1 * | 12/2011 | Varns | B60H 1/00014 296/64 |
| 2014/0150286 | A1 | 6/2014 | Jadhav et al. | |

FOREIGN PATENT DOCUMENTS

| | | | |
|---|---|---|---|
| DE | 102013103647 | A1 | 10/2014 |
| DE | 102014222541 | A1 | 5/2016 |
| EP | 2465406 | B1 | 5/2017 |

* cited by examiner

*Primary Examiner* — Jessica Yuen
(74) *Attorney, Agent, or Firm* — Dority & Manning, P.A.

(57) ABSTRACT

A dishwashing appliance includes a tub defining a wash chamber. An inlet is defined in the tub and provides air flow into the wash chamber. An air handler selectively urges air through the inlet in one of a first direction and a second direction different from the first direction. The air flows from the inlet and through the wash chamber of the tub along a first defined path when the air handler urges air through the inlet in the first direction, and the air flows from the inlet and through the wash chamber of the tub along a second defined path when the air handler urges air through the inlet in the second direction.

17 Claims, 17 Drawing Sheets

DRYING SYSTEMS AND METHODS INCLUDING MULTI-DIRECTIONAL AIR DISTRIBUTION FOR A DISHWASHING APPLIANCE

FIELD

The present subject matter relates generally to washing appliances, such as dishwashing appliances and, more particularly, to an air distribution assembly of a washing appliance and related methods.

BACKGROUND

Dishwashing appliances generally include a tub that defines a wash chamber. Rack assemblies can be mounted within the wash chamber for receipt of articles for washing where, e.g., detergent, water, and heat, can be applied to remove food or other materials from dishes and other articles being washed. Various cycles may be included as part of the overall cleaning process. For example, a typical, user-selected cleaning option may include a wash cycle and rinse cycle (referred to collectively as a wet cycle), as well as a drying cycle. In addition, spray-arm assemblies within the wash chamber may be used to apply or direct fluid towards the articles disposed within the rack assemblies in order to clean such articles, e.g., during the wet cycle.

In the drying cycle, air may be introduced into the wash chamber to promote drying of articles therein. However, air introduction assemblies typically provide a fixed direction of air flow which results in incomplete or inconsistent coverage of the articles in the wash chamber with the introduced air.

Accordingly, improved air distribution systems and methods for a dishwashing appliance which provide improved distribution of air during a drying cycle would be welcomed.

BRIEF DESCRIPTION

Aspects and advantages of the technology will be set forth in part in the following description, or may be obvious from the description, or may be learned through practice of the technology.

In one embodiment a dishwashing appliance is provided. The dishwashing appliance includes a tub defining a wash chamber. An inlet is defined in the tub and provides air flow into the wash chamber. An air handler selectively urges air through the inlet in one of a first direction and a second direction different from the first direction. The air flows from the inlet and through the wash chamber of the tub along a first defined path when the air handler urges air through the inlet in the first direction, and the air flows from the inlet and through the wash chamber of the tub along a second defined path when the air handler urges air through the inlet in the second direction.

In another embodiment, a method of drying dishes in a dishwashing appliance is provided. The method includes urging air through an inlet defined in a tub of the dishwashing appliance in a first direction, such that the air flows from the inlet and through a wash chamber of the tub along a first defined path and urging air through the inlet defined in the tub of the dishwashing appliance in a second direction, such that the air flows from the inlet and through the wash chamber of the tub along a second defined path.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 11 provides a rear perspective view of a vent and a diverter of an air distribution system for a dishwashing appliance according to one or more embodiments of the present subject matter.

DETAILED DESCRIPTION

Figure 1:
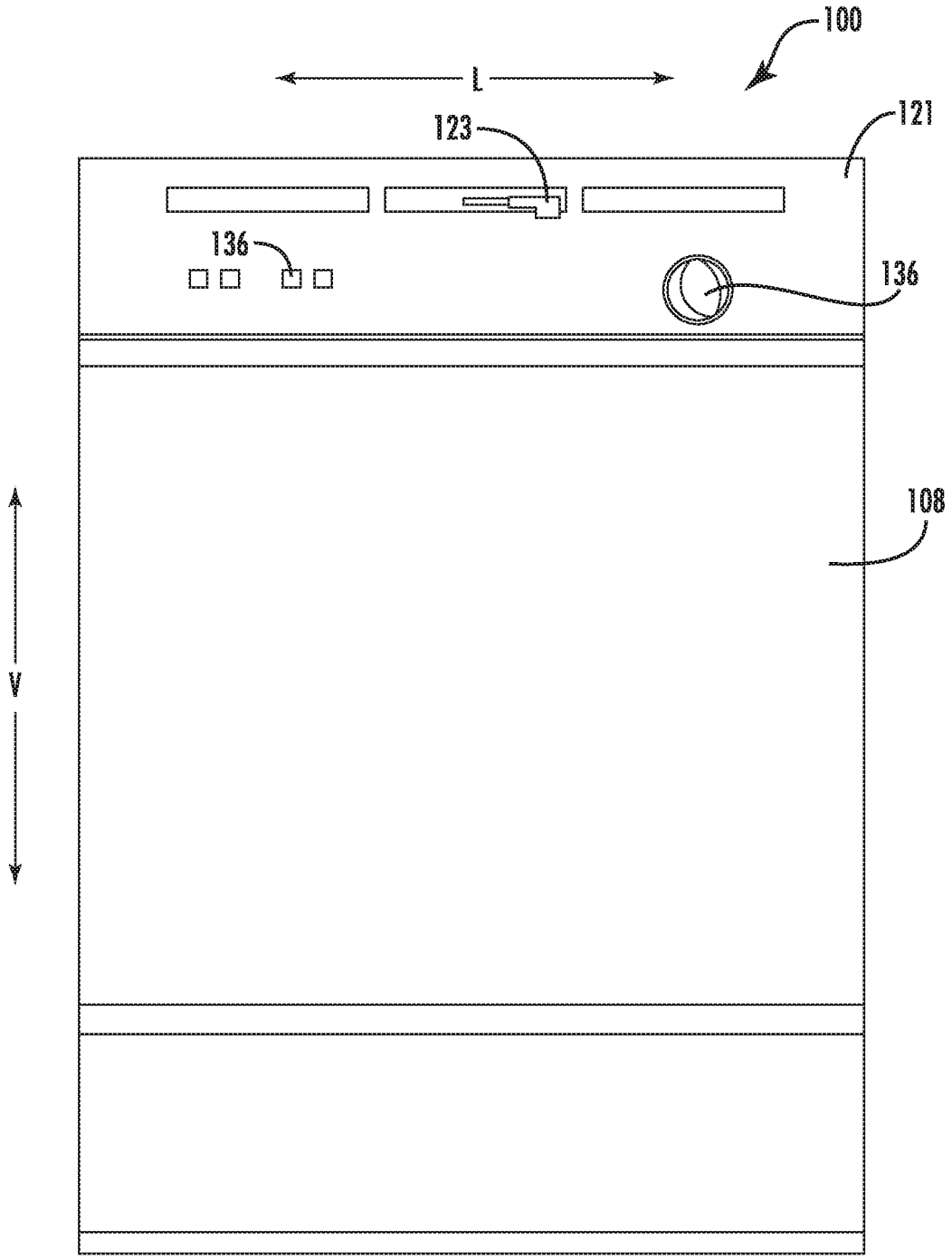
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
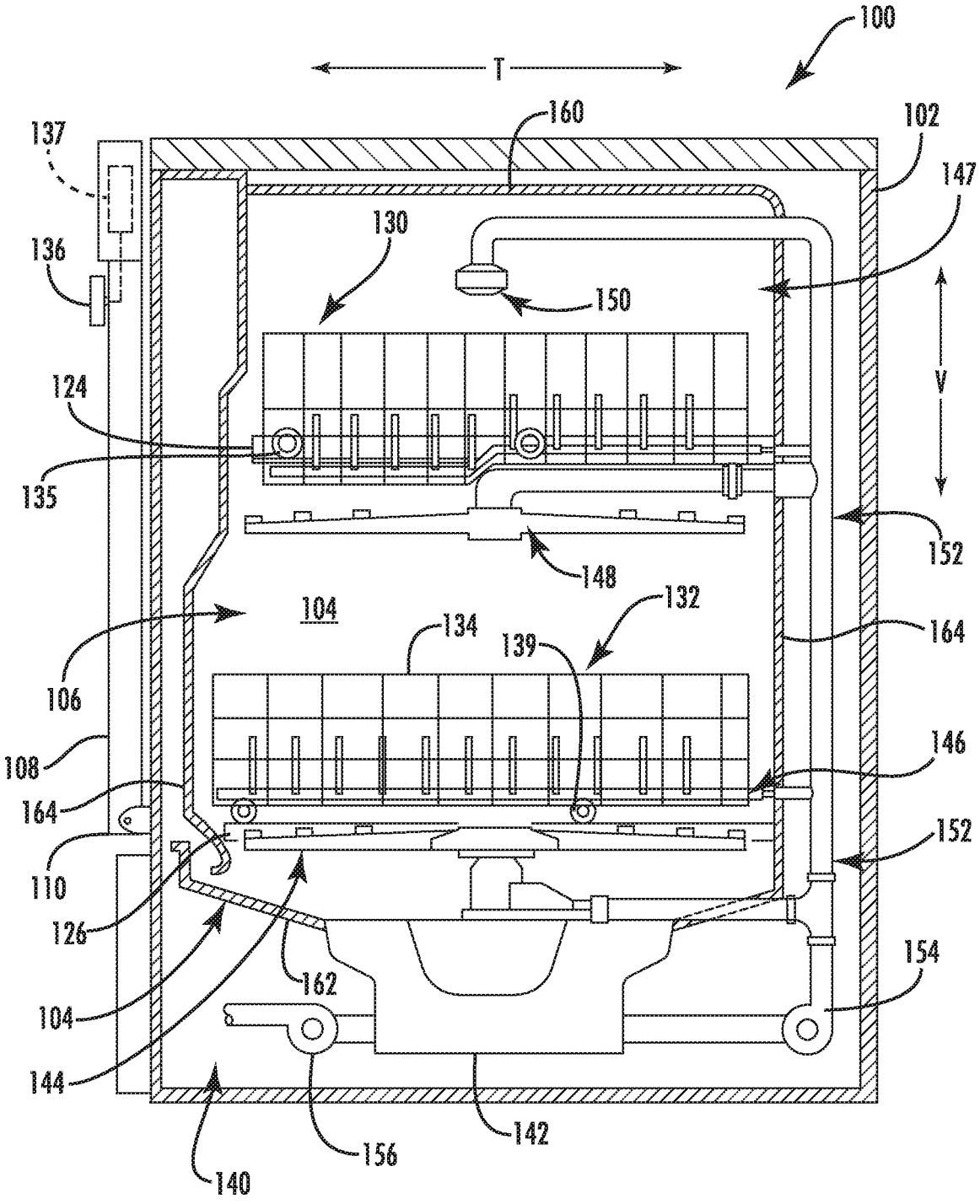
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located above the lower spray-arm assembly 144 within the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid which may also include water, detergent, and/or other additives, and may be referred to as wash fluid) within the tub 104. As shown in FIG. 2, the fluid circulation system 152 may also include a recirculation pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The tub 104 may include a sump 142 positioned at a bottom of the wash chamber 106 for receiving fluid from the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing fluid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

A drain pump 156 may also be provided in the machinery compartment 140 and in fluid communication with the sump 142. The drain pump 156 may be in fluid communication with an external drain (not shown) to discharge fluid, e.g., used wash liquid, from the sump 142.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses. It should be noted that controllers 137 as disclosed herein are capable of and may be operable to perform any methods and associated method steps as disclosed herein.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
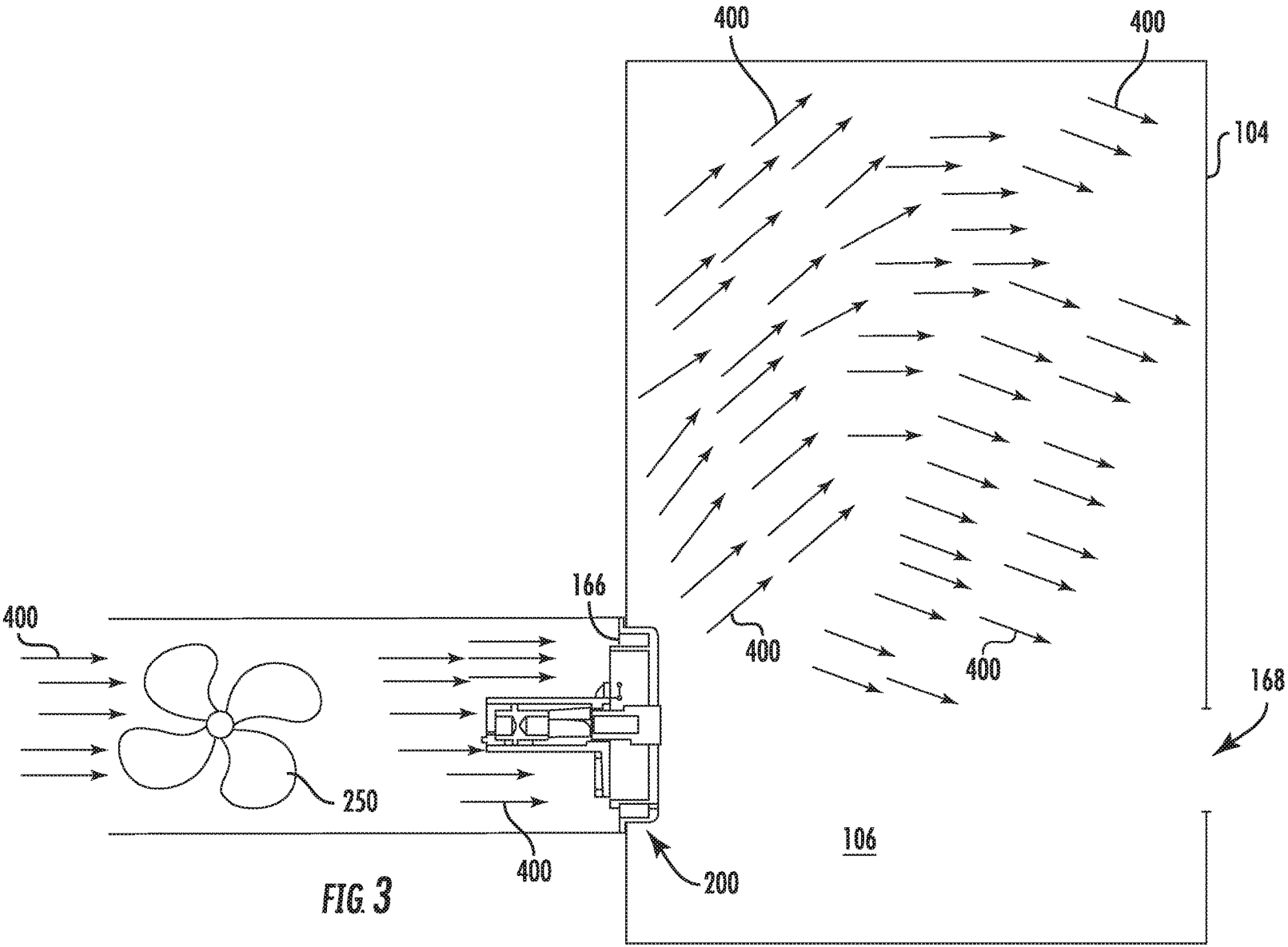
FIG. 3 provides a schematic view of a dishwashing appliance including a first defined air flow path according to one or more embodiments of the present subject matter.
Figure 4:
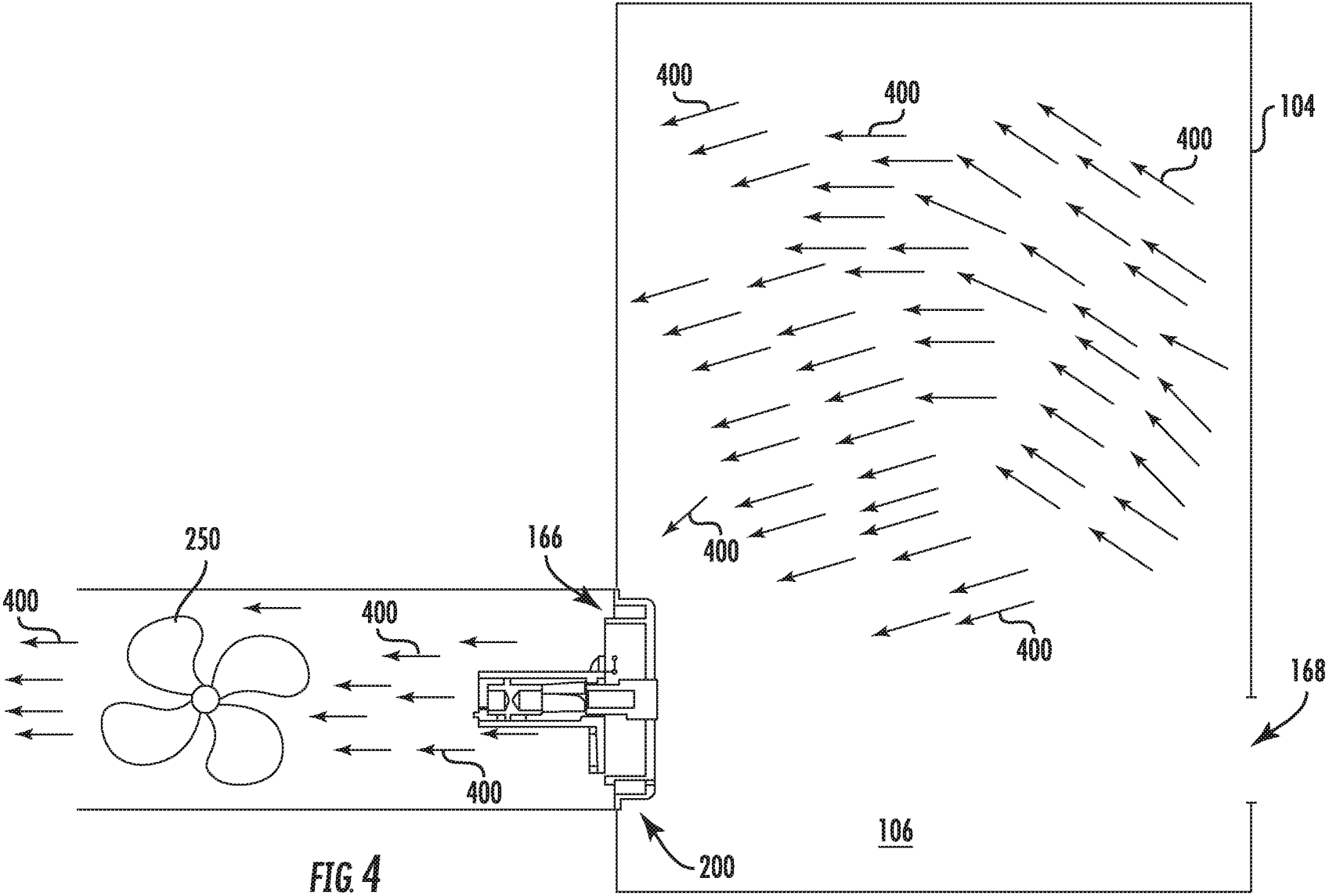
FIG. 4 provides a schematic view of the dishwashing appliance of FIG. 3 including a second defined air flow path.
Figure 5:
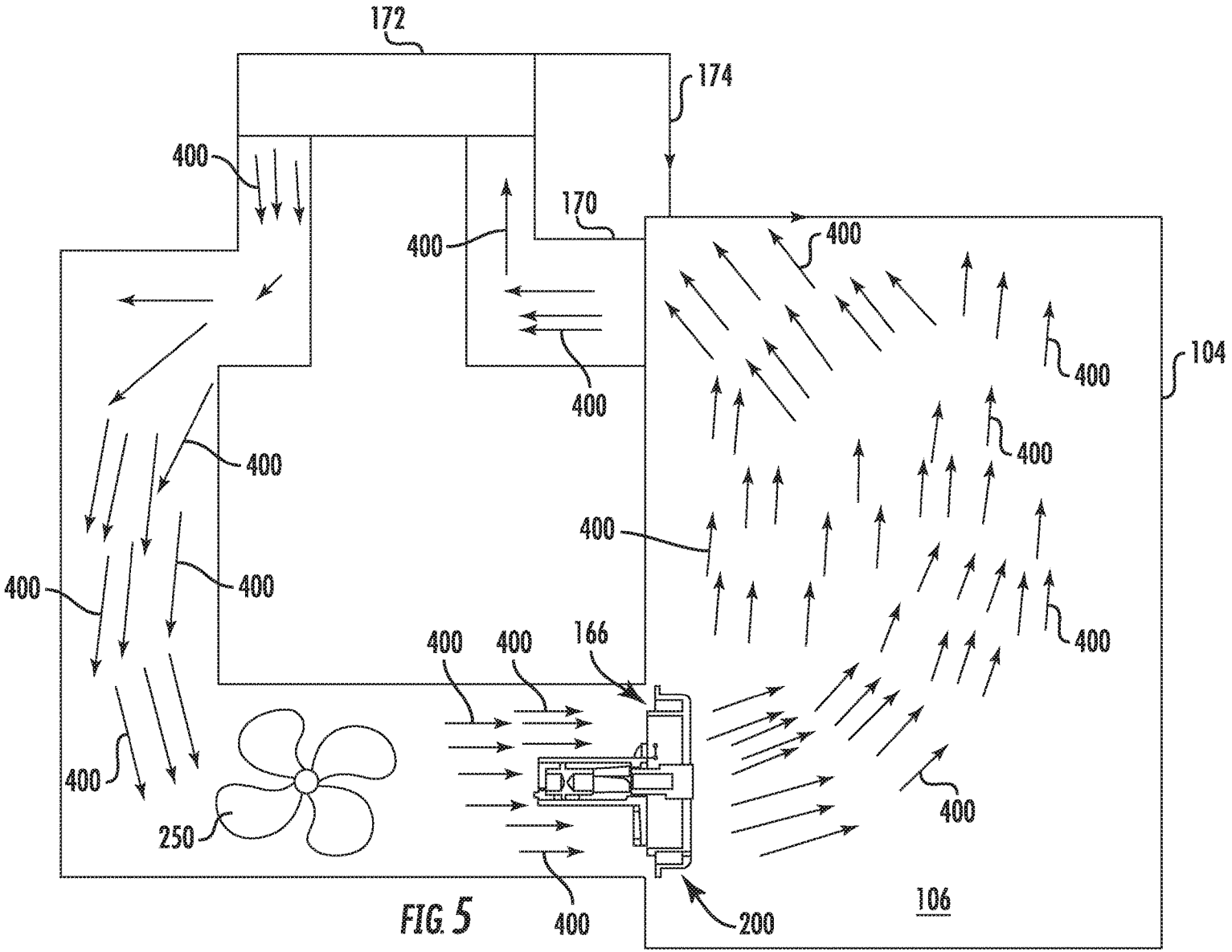
FIG. 5 provides a schematic view of a dishwashing appliance including a first defined air flow path according to one or more additional embodiments of the present subject matter.
Figure 6:
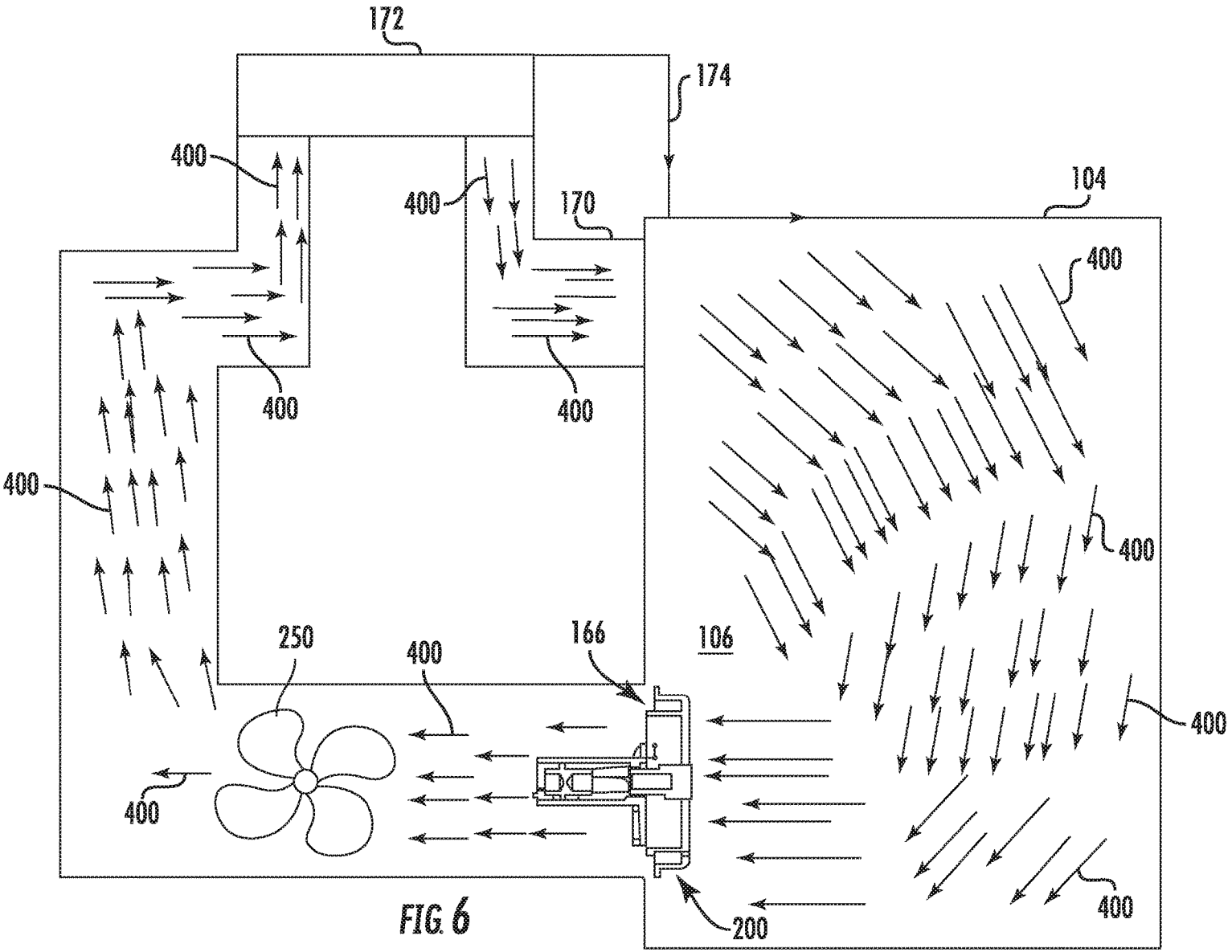
FIG. 6 provides a schematic view of the dishwashing appliance of FIG. 5 including a second defined air flow path.

Turning now to FIGS. 3 through 6, a flow of air 400 may be provided in order to promote drying of the wash chamber 106 and/or of wet articles therein. The flow of air 400 may be urged through the wash chamber 106 by an air handler, e.g., including one or more fans 250, as illustrated in FIGS. 3 through 6. For example, the fan 250 may be a radial fan which urges the air 400 in a radial direction of the fan 250, as illustrated in FIGS. 3 through 6. In such embodiments, the air handler may include a first radial fan 250 configured to urge the air in the first direction and a second radial fan 250 configured to urge the air in the second direction. The second radial fan 250 is substantially duplicative of the first radial fan 250, and the structure and operation of such radial fans 250 are well understood in the art. The air handler, e.g., fan(s) 250, may be configured to selectively urge air 400 through the inlet 166 in one of a first direction (e.g., FIGS. 3 and 5) and a second direction (e.g., FIGS. 4 and 6) different from, e.g., opposite of, the first direction. For example, in some embodiments, urging air in the first direction may include activating the first fan 250 and urging air in the second direction may include activating the second fan 250. The first and second fans may be radial fans, as mentioned, and in other embodiments one or both of the first and second fans may be any other suitable type of fan, such as an axial fan or fans. The flow of air 400 may travel through the wash chamber 106 to promote drying of dishes or other articles located in rack assemblies 130 and 132 within the wash chamber 106, whereupon the air 400 may impart thermal energy to and/or receive moisture from the articles and/or the wash chamber 106. More particularly, the dishwashing appliance 100 may be configured to provide air flow into the wash chamber 106 within the tub 104 alternately along two or more different defined paths during a drying cycle, such as first and second defined paths as illustrated in FIGS. 3 through 6, to impinge the air 400 on more than one side of articles, e.g., dishes, within the wash chamber 106. FIGS. 3 and 4 illustrate an open loop drying system, where the wash chamber 106 is in fluid communication with an ambient environment external to the dishwashing appliance 100. FIGS. 5 and 6 illustrate a closed loop drying system, where the wash chamber 106 is fluidly isolated from the ambient environment.

As shown in FIG. 3, air 400 may flow into the wash chamber 106 via an inlet 166 and along a first defined path when the air handler (e.g., fan(s) 250) urges the air in the first direction. The first defined path may be defined, in whole or in part, by one or more of the inlet 166, an air distribution assembly 200, the lower rack 132, the upper rack 130, and the walls 160, 162, and/or 164 of the tub 104. As may be seen in FIG. 3, when the air 400 flows along the first defined path, the air 400 may flow along a first direction, e.g., the air 400 may impinge on a first side of articles located in the rack assemblies 130 and 132 when the air 400 flows along the first defined path. In some embodiments, the drying system may be an open loop drying system. For example, the dishwashing appliance 100 may include an outlet 168 in the tub 104 such that the tub 104 is in fluid communication with an ambient environment around the dishwashing appliance 100. In such embodiments, e.g., as illustrated in FIG. 3, the first defined path may extend from the inlet 166, through the wash chamber 106, and to the outlet 168.

As shown in FIG. 4, air 400 may flow into the wash chamber 106 via the inlet 166 and along a second defined path when the air handler (e.g., fan(s) 250) urges the air in the second direction. The second defined path may be defined, in whole or in part, by one or more of the inlet 166, the air distribution assembly 200, the lower rack 132 (FIG. 2), the upper rack 130 (FIG. 2), and the walls 160, 162, and/or 164 of the tub 104. As may be seen in FIG. 4, when the air 400 flows along the second defined path, the air 400 may flow along a second direction which is different from the first direction, e.g., the second direction may be generally opposite the first direction. Thus, the air 400 may impinge on a second side, e.g., opposite the first side, of articles located in the rack assemblies 130 and 132 when the air 400 flows along the second defined path. In some embodiments, the drying system may be an open loop drying system. For example, as illustrated in FIG. 4, the second defined path may extend from the outlet 168, through the wash chamber 106, and to the inlet 166.

FIGS. 5 and 6 illustrate another example embodiment similar to the above-described embodiment illustrated by FIGS. 3 and 4. For example, the dishwashing appliance 100 schematically illustrated in FIGS. 5 and 6 may include an air handler, e.g., one or more radial fans 250, configured to selectively urge air 400 through the inlet 166 in one of a first direction (FIG. 5) and a second direction (FIG. 6), such that the air 400 flows along one of a first defined path (FIG. 5) and a second defined path (FIG. 6), to impinge on and promote drying of a first and second side, respectively, of articles in the racks 130 and 132. Aspects of the example embodiment illustrated in FIGS. 5 and 6 which are similar to those described above with respect to FIGS. 3 and 4 will not be described in further detail herein for the sake of brevity.

The example embodiment illustrated in FIGS. 5 and 6 may include a closed loop drying system. For example, the tub 104 may be fluidly isolated from the ambient environment—at least when the door 108 is closed, e.g., during the drying cycle—in some embodiments. Thus, as illustrated in FIGS. 5 and 6, the dishwashing appliance 100 may include a recirculation conduit 170 in fluid communication with the tub 104. In such embodiments, the first defined path may extend from the inlet 166 through the wash chamber 106 to the recirculation conduit 170 (FIG. 5), and the second defined path may extend from recirculation conduit 170 through the wash chamber 106 to the inlet 166 (FIG. 6). Further, as may be seen in FIGS. 5 and 6, the air 400 may return to the inlet 166 via the recirculation conduit 170 when flowing along the first defined path (FIG. 5) and may return to the wash chamber 106 from the inlet 166 via the recirculation conduit 170 when flowing along the second defined path (FIG. 6).

Some embodiments may further include a dehumidifier 172 located in the recirculation conduit 170, such that air 400 flowing through the recirculation conduit 170 flows across the dehumidifier. For example, the dehumidifier 172 may include a heat exchanger, such as a heat pipe heat exchanger, a thermoelectric device, or other suitable apparatus for removing or reducing moisture from the air 400 as the air 400 travels through the recirculation conduit 170. The structure and function of such dehumidifiers are generally understood by those of ordinary skill in the art and, as such, are not shown or described in further detail for the sake of clarity and concision. In embodiments including the dehumidifier 172, a condensate drain 174 may also be provided for collecting condensation from the dehumidifier 172 and directing the condensation to the tub 104, e.g., to the sump 142.

In various exemplary embodiments, the drying cycle may include sequentially providing air flow into the wash chamber 106 along at least two different paths, such as along each of the first and second defined paths. The air flow may be provided in any order, e.g., the sequence may begin with either of the first or second paths, and may also include additional paths, e.g., third, fourth, or fifth paths in some embodiments. In at least some embodiments, the dishwashing appliance 100 may be configured to provide generally the same air flow rate into the wash chamber 106 along each defined path.

Figure 18:
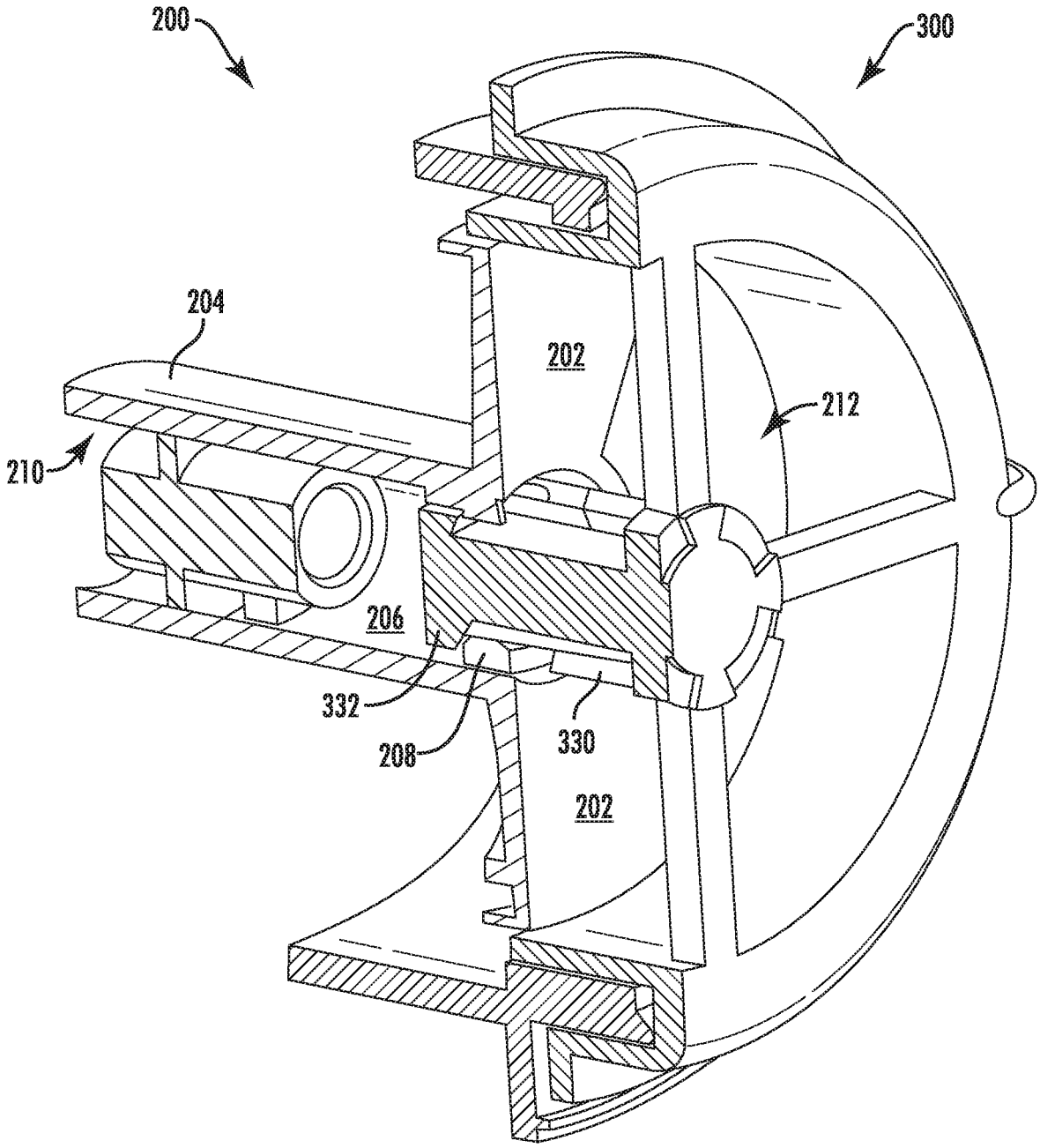
FIG. 18 provides a partially sectioned perspective view of a portion of the dishwashing appliance of FIG. 15 with the diverter in the second axial position and a second circumferential position.

As shown in FIGS. 7 through 10, the air 400 may be selectively directed along different paths, e.g., one of the defined paths described above, by an air distribution assembly 200 including a diverter disk 202 and a vent 300. The selected path along which the air 400 is directed may be based on a circumferential position of the diverter disk 202. The diverter disk 202 may be rotatably mounted in or proximate to the vent 300 such that the diverter disk 202 rotates between a plurality of circumferential positions. In at least some embodiments, the diverter disk 202 may be passively rotatable. For example, the diverter disk 202 may not be actively driven, e.g., by a motor or biasing element, between the multiple circumferential positions. For example, the diverter disk 202 may rotate between a first circumferential position and a second circumferential position (and other subsequent positions as well, such as to provide air flow along the multiple paths described above) in response to air flow driven by the air handler, e.g., one or more radial fans 250 (FIGS. 3 through 6) or an axial fan 250 (e.g., FIGS. 15 and 16) upstream of the diverter disk 202. The second circumferential position is shown in FIG. 18. The vent 300 may be located at the inlet 166 into the wash chamber 106. With the vent 300 located at the inlet 166, the diverter disk 202 mounted in or to the vent 300 is disposed proximate the inlet 166.

Figure 7:
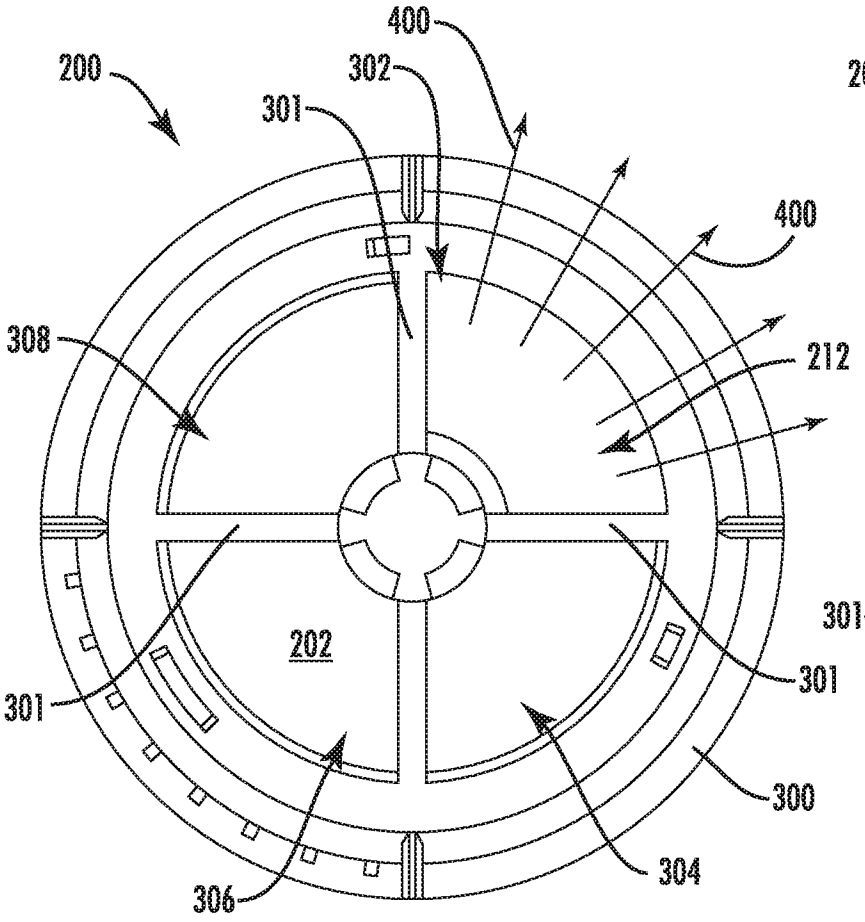
FIG. 7 provides a front view of an air distribution system for a dishwashing appliance in a first position according to one or more embodiments of the present subject matter in the first position.

In some embodiments, for example as illustrated in FIGS. 7 through 10, the vent 300 may comprise a plurality of arms 301 which define multiple outlets of the vent. For example, the arms 301 may divide the vent 300 into four quadrants 302, 304, 306, and 308, as shown in FIGS. 7 through 10. In some embodiments, the diverter disk 202 may include a single aperture 212. For example, in some embodiments, the diverter disk 202 may be circular and the aperture 212 may extend along an arc of approximately ninety degrees. In embodiments where the vent 300 includes the four quadrants 302, 304, 306, and 308 and the diverter disk 202 includes the single aperture 212, the diverter disk 202 may rotate through four circumferential positions to align the aperture 212 with each quadrant 302, 304, 306, and 308 of the vent 300 in sequence and another four intermediate circumferential positions, for a total of eight circumferential positions. The eight circumferential positions may be spaced apart by about forty-five degrees. As also described above with reference to FIGS. 3 through 6, air 400 may flow along the first defined path when the aperture 212 of the diverter disk 202 is aligned with the first quadrant 302 of the vent 300, e.g., as shown in FIG. 7, where the diverter disk 202 is in a first circumferential position and the air 400 may flow along the second defined path when the diverter disk is in the second circumferential position (FIG. 18).

Figure 8:
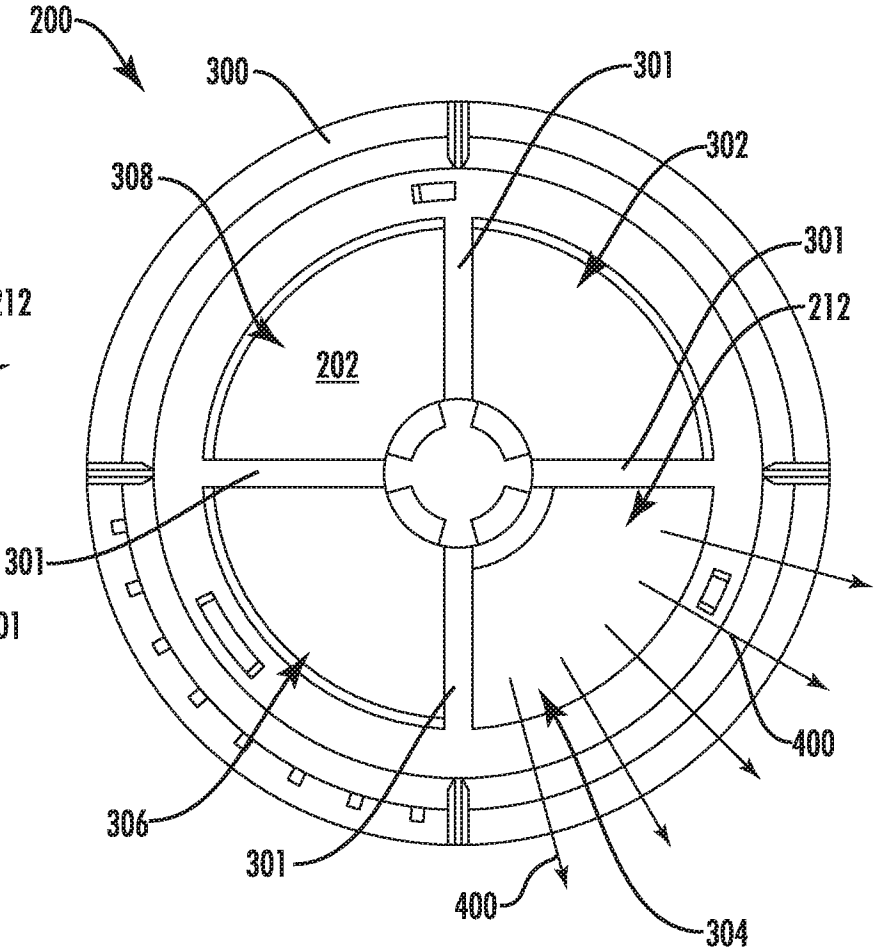
FIG. 8 provides a front view of the air distribution system of FIG. 7 in a second position.
Figure 10:
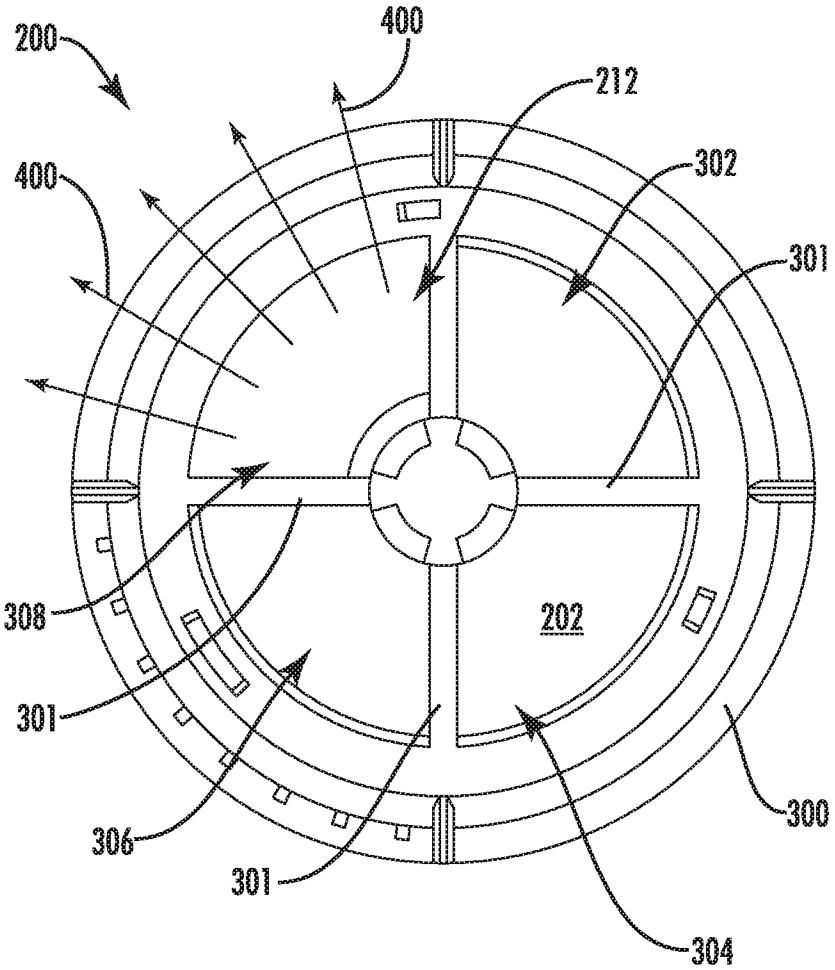
FIG. 10 provides a front view of the air distribution system of FIG. 7 in a fourth position.
Figure 9:
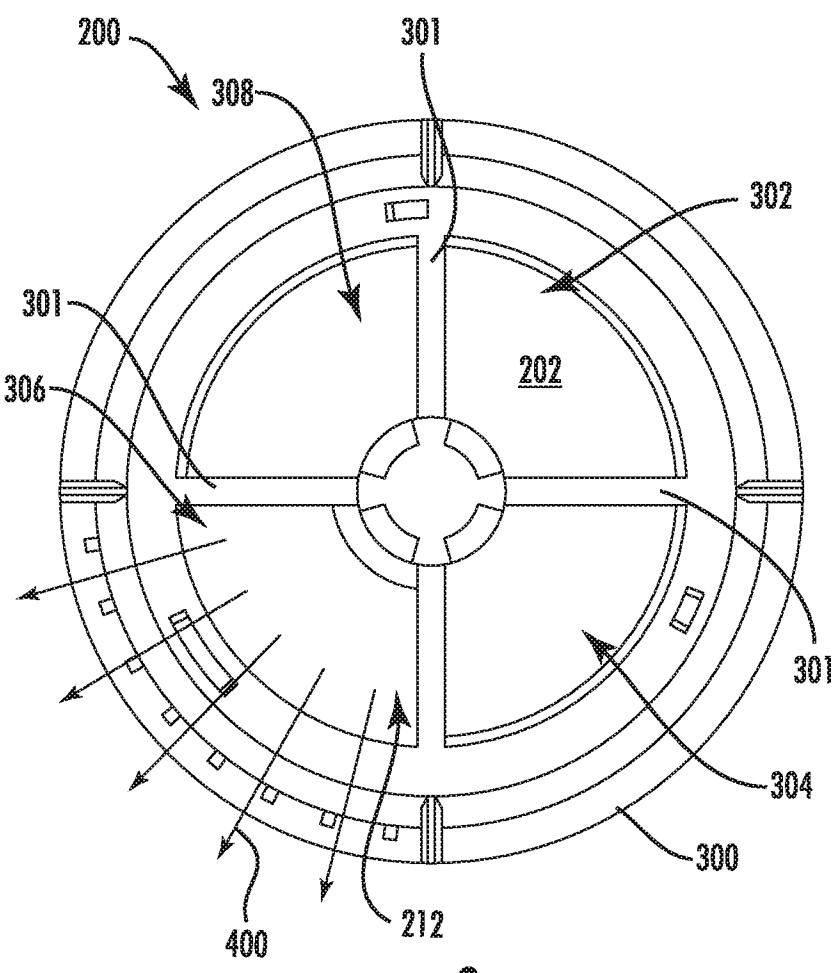
FIG. 9 provides a front view of the air distribution system of FIG. 7 in a third position.

As shown in FIG. 8, air 400 may also flow along a third defined path when the diverter disk 202 is in a third circumferential position after passing through an intermediate second circumferential position between the first and third circumferential positions. The air 400 will flow along the second defined path when the diverter disk 202 is in the second circumferential position. In the third circumferential position, as shown in FIG. 8, the aperture 212 of the diverter disk 202 is aligned with the second quadrant 304 of the vent 300. As shown in FIG. 9, air 400 may flow along a fifth defined path when the aperture 212 of the diverter disk 202 is in a fifth circumferential position and aligned with the third quadrant 306 of the vent 300. As shown in FIG. 10, air 400 may flow along a seventh defined path when the aperture 212 of the diverter disk 202 is in a seventh circumferential position and aligned with the fourth quadrant 308 of the vent 300. The diverter disk may further travel through an intermediate eighth circumferential position (wherein the air 400 flows along an eighth defined path) and then return to the first circumferential position of FIG. 7. The air distribution assembly 200 may be configured to provide generally the same air flow rate into the wash chamber along each path. For example, the quadrants 302, 304, 306, and 308 of the vent may be generally equivalent in size, in particular in cross-sectional area, such that the rate of air flow through the vent 300 is generally the same when the aperture 212 is aligned with each quadrant 302, 304, 306, and 308.

Figure 12:
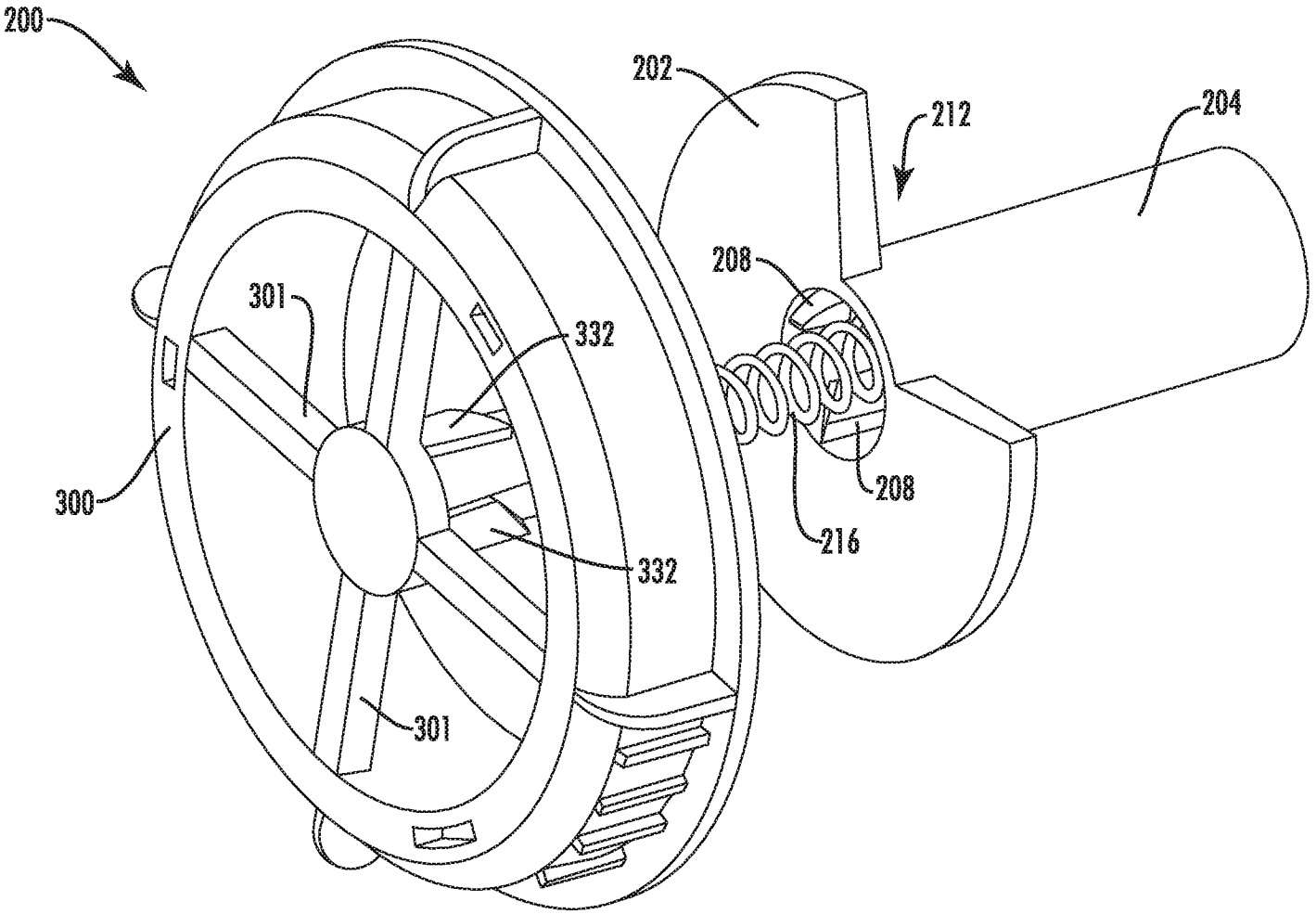
FIG. 12 provides a front perspective view of the vent and diverter of FIG. 11.

FIG. 11 provides an exploded view of an exemplary air distribution assembly 200 including a diverter disk 202, vent 300, and an optional biasing element 216 between the diverter disk 202 and the vent 300. As seen in FIGS. 11 and 12, the diverter disk 202 may define an axial direction A, a radial direction R, and a circumferential direction C. The view of FIG. 11 is looking in a first direction along the axial direction A. FIG. 12 provides an exploded view of the air distribution assembly of FIG. 11 looking in a second direction along the axial direction A. More particularly, the diverter disk 202 includes a generally circular main body with at least one aperture 212 defined therein, the circumferential direction C defined by an outermost perimeter of the disk 202, and a cylindrical shaft 204 that extends along the axial direction A. The vent 300 may include a cylindrically-shaped boss 310 which extends along the axial direction A and includes a plurality of guide elements 330 and 332 that extend radially outward from the boss 310 and are spaced apart from each other along axial and circumferential directions A and C. The cylindrical shaft 204 may be configured to interengage with the boss 310, and in particular cams 208 (FIG. 12) on the cylindrical shaft 204 may engage the guide elements 330 and 332 on the boss 310, such that the diverter disk 202 is rotatable about the axial direction A, e.g., along the circumferential direction C, relative to vent 300 and movable back and forth along axial direction A, e.g., between a first axial position and a second axial position, as described in more detail below.

Figure 15:
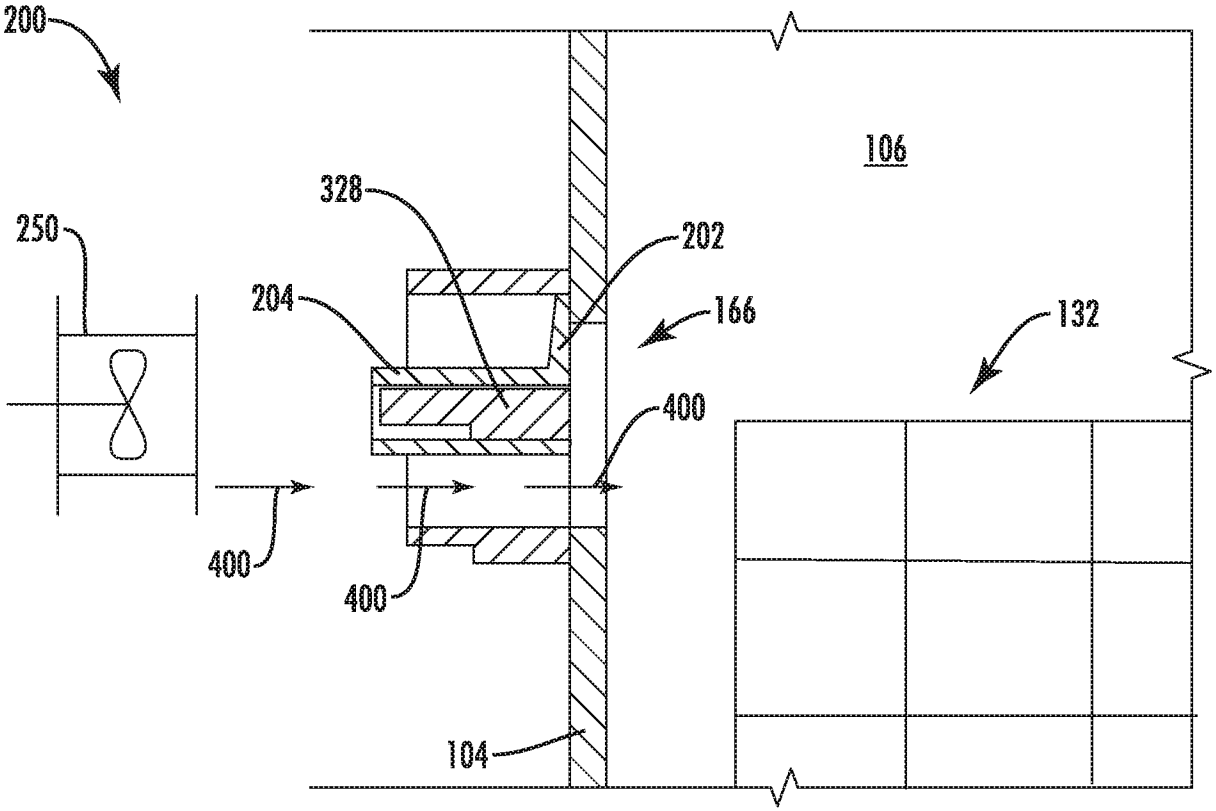
FIG. 15 provides a section view of a portion of a dishwashing appliance according to one or more embodiments of the present subject matter with a diverter in a first axial position.
Figure 16:
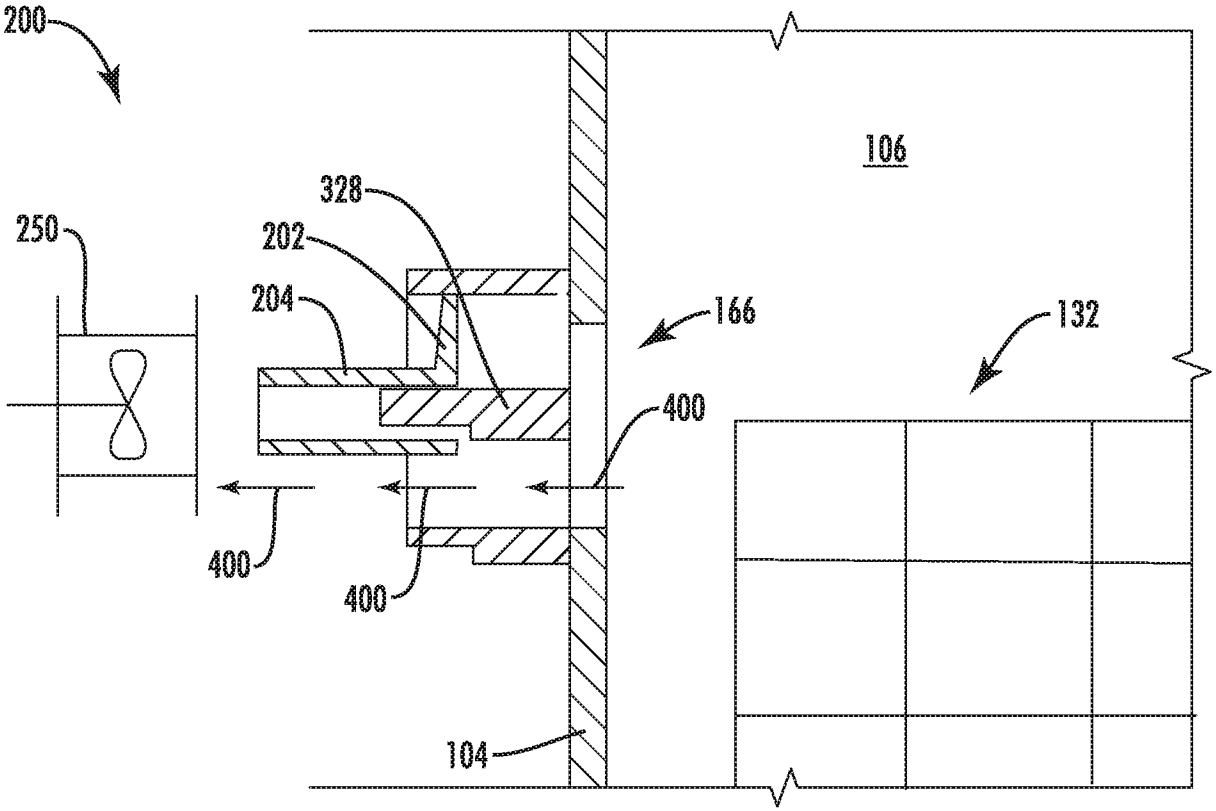
FIG. 16 provides a section view of a portion of the dishwashing appliance of FIG. 15 with the diverter in a second axial position.
Figure 17:
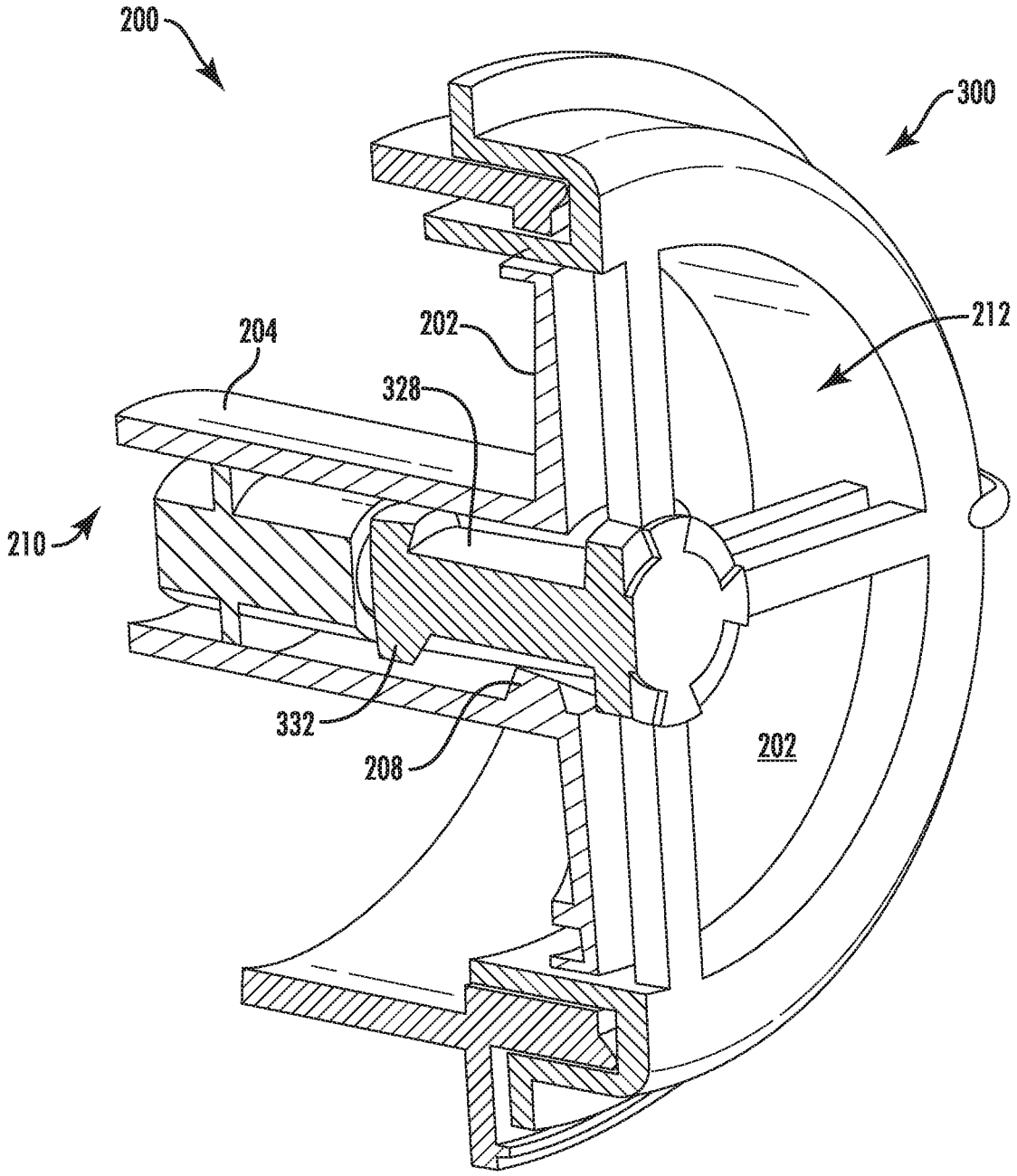

In various embodiments, the diverter disk 202 may be configured to move along the axial direction A by the force of air flowing through the air distribution assembly 200, e.g., air urged by the air handler. In some embodiments, the air handler may be a single fan 250 which may be a variable direction fan, e.g., the fan 250 may be configured to selectively rotate in a first direction and a second direction, and thereby selectively urge the air along one of several possible different directions, such as at least two different directions, such as or three or more different directions. For example, in such embodiments, the single fan 250 may be an axial fan, e.g., may urge the air 400 along or generally parallel to an axis of the single fan 250, as illustrated in FIGS. 15 and 16. The fan 250 may be configured to alternate directions or cycle through the different possible directions in any desired sequence, e.g., a first direction followed by a second direction, followed by a third direction and then returning to the first direction. In various embodiments, any number of directions may be provided in any order. For example, the fan 250 may be configured to selectively urge air through the inlet 166 in one of a plurality of different directions. The plurality of different directions includes at least a first direction and a second direction. The second direction is different from the first direction. For example, the second direction may be generally orthogonal to the first direction, e.g., the first and second directions may be spaced apart by about ninety degrees (90°). As another example, the second direction may be opposite the first direction, e.g., the first and second directions may be spaced apart by about one hundred eighty degrees (180°). In some embodiments, the first direction may be oriented generally along the axial direction A (e.g., the direction of the view of FIG. 11) and the second direction may be opposite the first direction along the axial direction A (e.g., the direction of the view of FIG. 12). Thus, the diverter disk 202 may be configured to move in the first direction, e.g., towards the vent 300, when the fan 250 urges air through the inlet 166 in the first direction, and the diverter disk 202 may be configured to move in the second direction when the fan 250 urges air through the inlet 166 in the second direction. That is, the fan 250 may urge the diverter disk 202 to move from the second axial position to the first axial position when the fan 250 urges air through the inlet 166 in the first direction, and the fan 250 may urge the diverter disk 202 to move from the first axial position to the second axial position when the fan 250 urges air through the inlet 166 in the second direction. In some embodiments, the biasing element 216 may be configured and arranged to bias the diverter disk 202 along the axial direction A in the second direction opposite the first direction. The diverter disk 202 may rotate about the axial direction A, e.g., along the circumferential direction C, as it translates along the axial direction A. For example, the diverter disk 202 may rotate from the first circumferential position to the second circumferential position when it moves in the second direction along the axial direction A and may rotate from the second circumferential position to the third circumferential position when the diverter disk 202 moves in the first direction along the axial direction A, e.g., from the second axial position back to the first axial position, in response to the air flow from the fan 250.

In some embodiments the air distribution assembly 200 may be positioned within the dishwashing appliance 100 such that the axial direction A of the diverter disk 202 is oblique to the vertical direction V. In such embodiments, the diverter disk 202 may thusly be configured to translate along the axial direction A to the second axial position from the first axial position due to gravity as well as the force of the air moving through the inlet 166 in the second direction when the axial direction A is oblique to the vertical direction V. In various embodiments, the diverter disk 202 may be moved from the first axial position to the second axial position by the fan 250 urging air in the second direction alone, or movement of the diverter disk 202 in the second direction may be assisted by the biasing element 216 and/or gravity.

Figure 14:
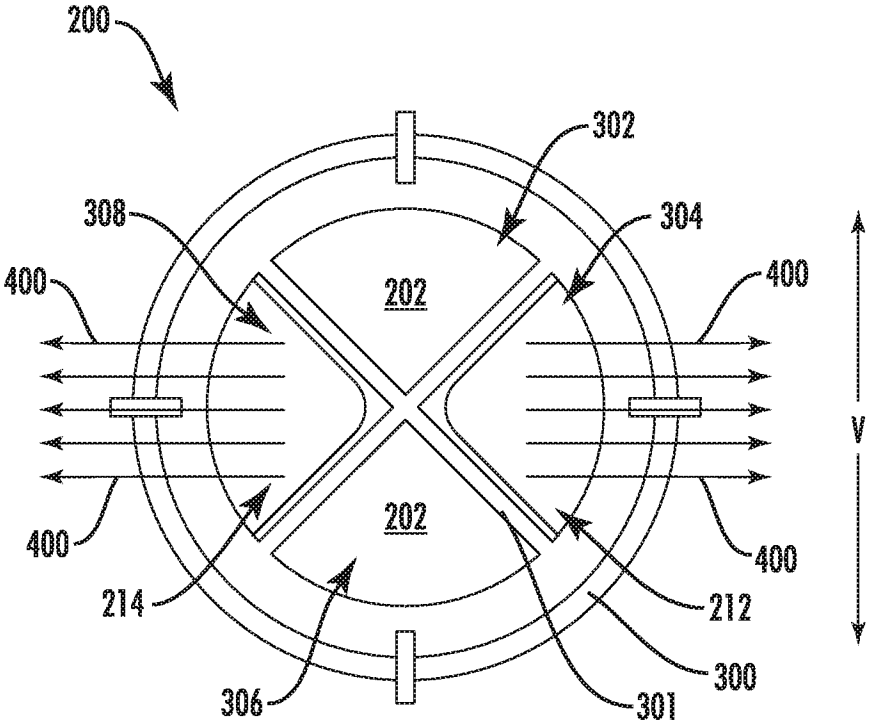
FIG. 14 provides a front view of the air distribution system of FIG. 13 in a second position.

In some embodiments, the air flow distribution assembly 200 may be configured to provide two air flow paths into the tub 104 of the dishwashing appliance 100 when the air 400 is urged in each direction. For example, FIGS. 14 and 15 show two air flow paths when the air 400 is urged in the first direction. Thus, the path as shown in FIG. 14 may be a first defined path, and the path be as shown in FIG. 15 may be a third defined path, and the air 400 may also travel along a second and fourth defined path (not shown) when the air handler urges the air 400 in the second direction. In such embodiments, the first defined path may be generally vertical, e.g., generally along the vertical direction V, and the third defined path may be generally horizontal, e.g., generally perpendicular to the vertical direction V, such as along one of the lateral direction L and the transverse direction T, while the second and fourth defined paths would be oblique, e.g., at an angle of about forty-five degrees, to the vertical direction V. In such embodiments, the diverter disk 202 may include a first aperture 212 and a second aperture 214. The diverter disk 202 may be configured to provide generally the same air flow rate into the wash chamber 106 along each of the various paths. For example, the first and second apertures 212 and 214 may be generally equivalent in size, e.g., cross-sectional area. For example, in some embodiments where the first aperture 212 extends along an arc of approximately ninety degrees along the circumferential direction C, the second aperture 214 may extend along an equivalent arcuate extent as the first aperture 212.

Figure 13:
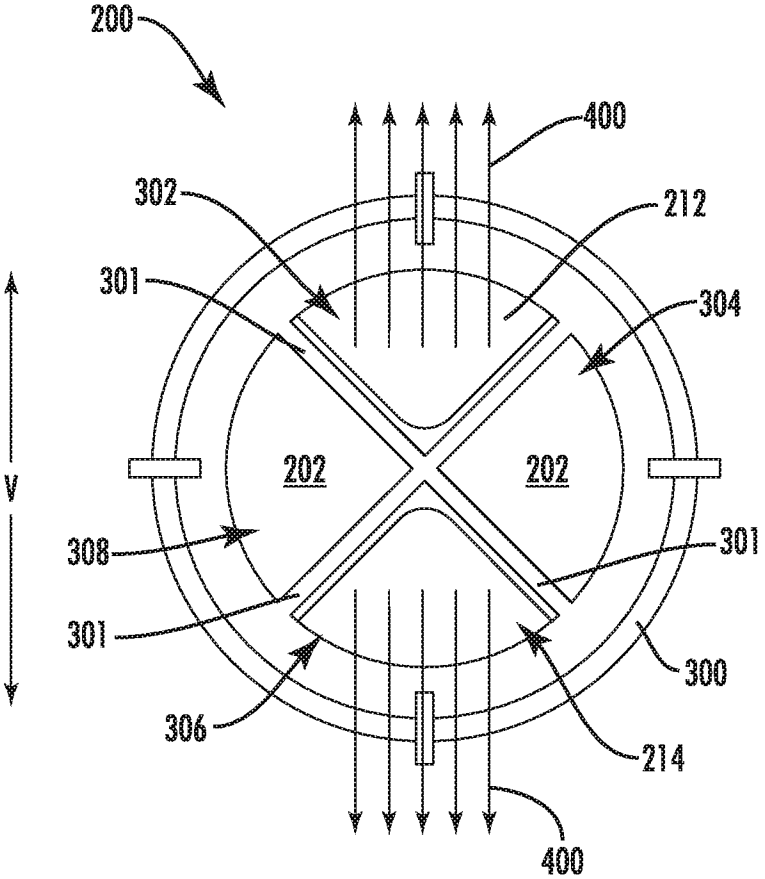
FIG. 13 provides a front view of an air distribution system for a dishwashing appliance according to one or more further additional embodiments of the present subject matter in a first position.

Additionally, the quadrants 302, 304, 306, and 308 of the vent 300 may be generally equivalent in size. Further, in embodiments such as illustrated in FIGS. 13 and 14, the quadrants 302, 304, 306, and 308 may be oriented such that a first pair of opposing quadrants, e.g., first quadrant 302 and third quadrant 306, are aligned along the vertical direction V, and a second pair of opposing quadrants, e.g., second quadrant 304 and fourth quadrant 308, are aligned along a direction perpendicular to the vertical direction V. In such embodiments, the diverter disk 202 may be rotatable between a first circumferential position where the first aperture 212 is aligned with the first quadrant 302 and the second aperture 214 is aligned with the third quadrant 306, to direct the air 400 vertically, as shown in FIG. 13, and a third circumferential position where the first aperture 212 is aligned with the second quadrant 304 and the second aperture 214 is aligned with the fourth quadrant 308, to direct the air along a horizontal path, as shown in FIG. 14.

The air distribution assembly 200 may be configured to provide generally the same air flow rate into the wash chamber 106 when the diverter disk 202 is in either of the first circumferential position and the third circumferential position. For example, in embodiments where the diverter disk 202 includes multiple apertures, e.g., as illustrated in FIGS. 13 and 14 the apertures may be equally sized, e.g., may have an equivalent or generally equivalent arcuate extent along the circumferential direction C.

As shown in FIGS. 15 and 16, in some embodiments the diverter disk 202 may be movable along the axial direction A between a first axial position (FIG. 15) and a second axial position (FIG. 16). For example, the dishwashing appliance 100 may include a fan 250 configured to urge the air 400 through the inlet 166 in one of the first direction and the second direction, and/or a third direction, etc., as mentioned above, such that the diverter disk 202 moves from the second axial position of FIG. 16 to the first axial position of FIG. 15 when the fan 250 urges air 400 through the inlet 166 in the first direction, and the diverter disk 202 moves from the first axial position to the second axial position when the fan 250 urges air 400 through the inlet 166 in the second direction. For example, the first defined path may be oriented into a lower portion of the wash chamber 106, e.g., proximate lower rack 132, as illustrated in FIG. 15, and the second defined path may be oriented out of the lower portion of the wash chamber, e.g., as illustrated in FIG. 16.

Figure 17:
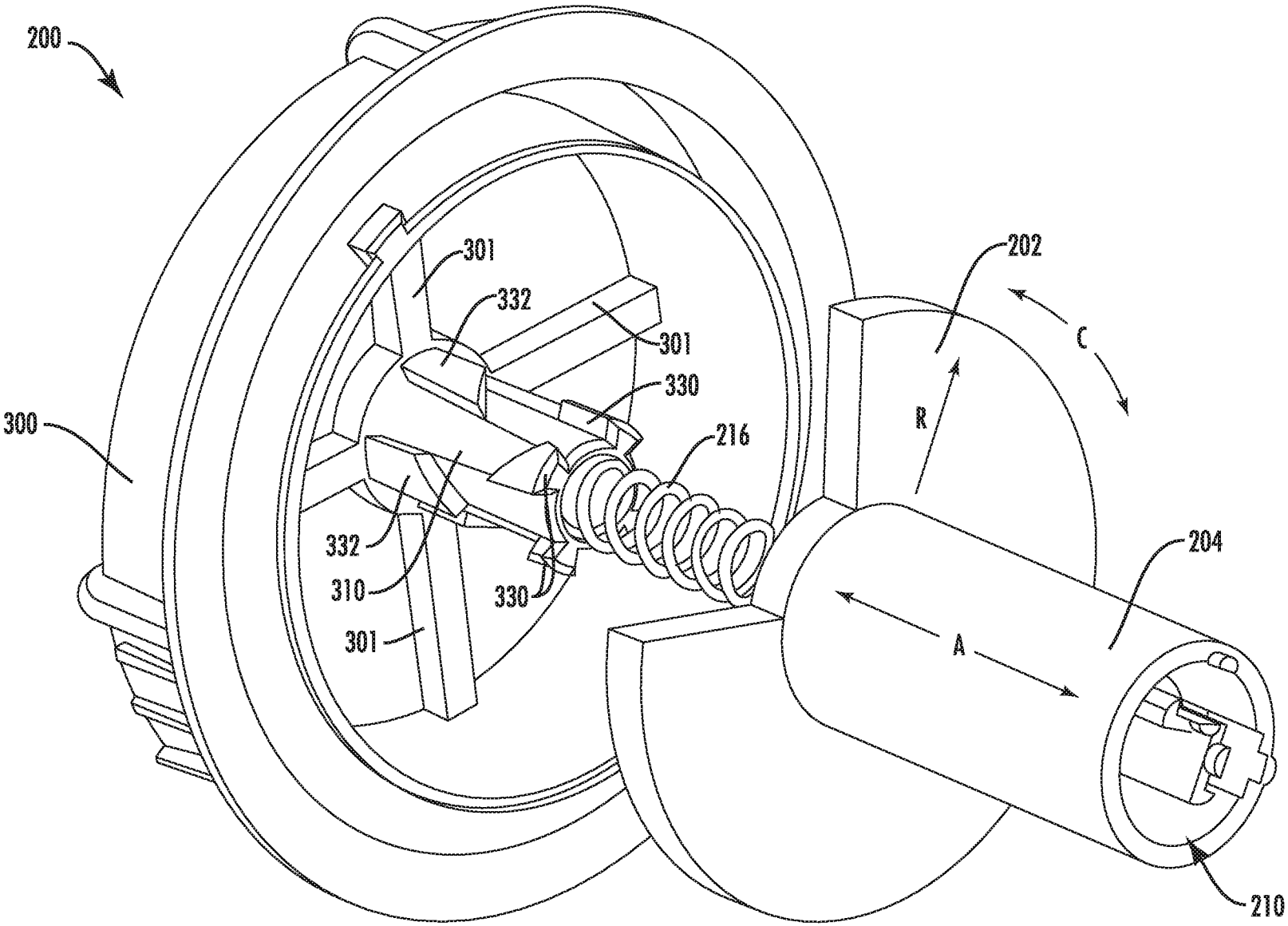
FIG. 17 provides a partially sectioned perspective view of a portion of the dishwashing appliance of FIG. 15 with the diverter in the first axial position and a first circumferential position.
Figure 19:
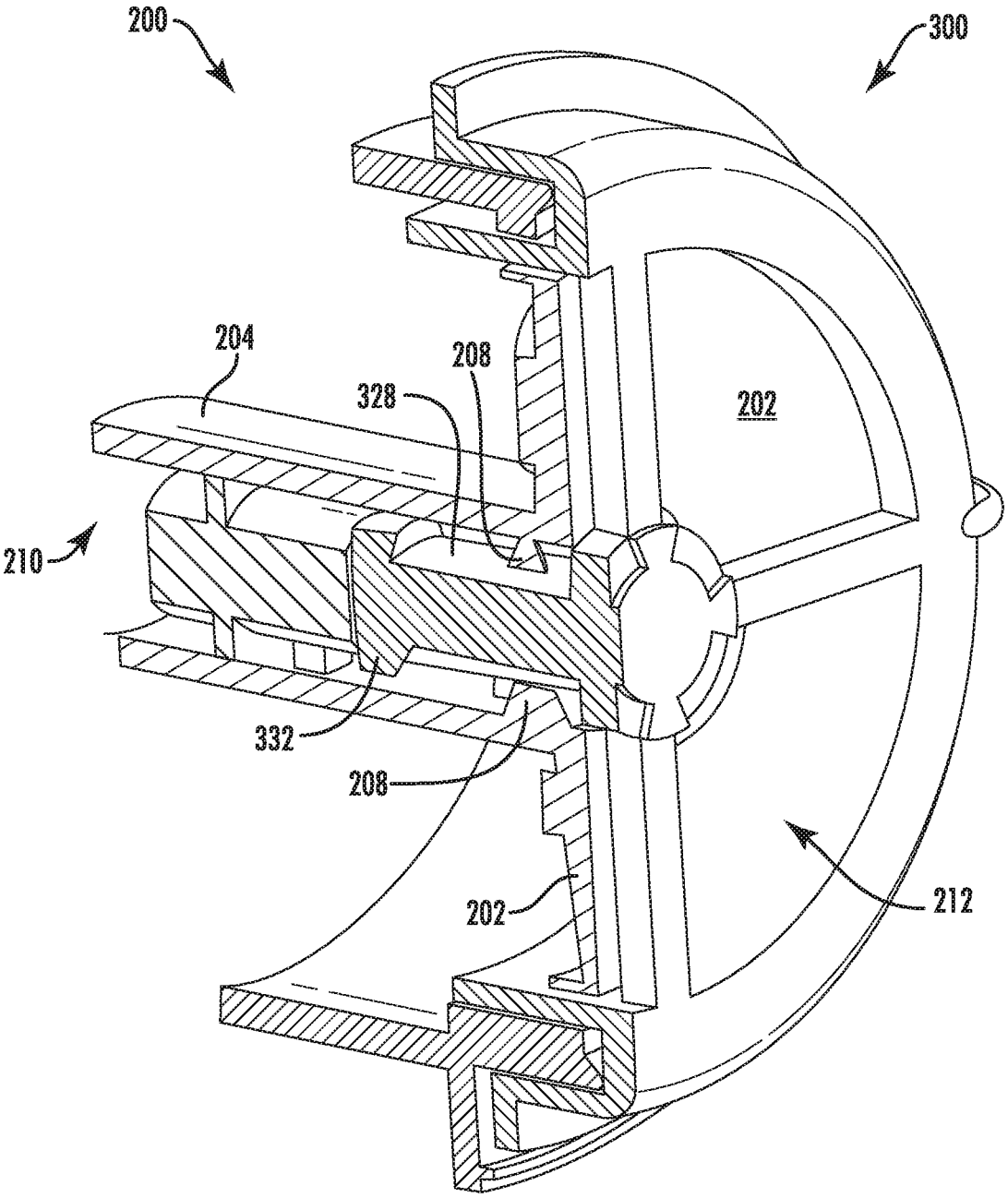
FIG. 19 provides a partially sectioned perspective view of a portion of the dishwashing appliance of FIG. 15 with the diverter in the first axial position and a third circumferential position.

As mentioned above, the cylindrical shaft 204 of the diverter disk 202 may be configured to interengage with guide elements 330 and 332, which in some embodiments are disposed on the boss 310 of the vent 300 and in other embodiments are disposed on a boss 328 of the duct 320. As best seen in FIGS. 17 through 19, the cylindrical shaft 204 may be hollow such that the cylindrical shaft 204 defines an interior channel 210 with an internal surface 206 (FIG. 18). The diverter disk 202 may further include a plurality of cams 208 disposed on the internal surface 206 of the cylindrical shaft 204 and projecting radially inward from the internal surface 206 of the cylindrical shaft 204 into interior channel 210. As best seen in FIG. 12, each cam 208 is spaced apart from adjacent cams 208 along the circumferential direction C, and each cam 208 is at the same axial position along the axial direction A. Accordingly, as described herein, one of skill in the art will appreciate that the guide elements 330, 332 and the cams 208 are configured to contact each other when the diverter disk 202 moves along the axial direction A so as to cause the diverter disk 202 to rotate incrementally through a plurality of angular positions, e.g., to rotate forty five degrees from the first circumferential position (FIG. 17) to the second circumferential position (FIG. 18) as diverter disk 202 travels along the axial direction from the first axial position to the second axial position and to rotate an additional forty five degrees when the diverter disk 202 returns from the second axial position to the first axial position, thereby completing a ninety-degree rotation, such as from the first circumferential position of FIG. 7 to the third circumferential position of FIG. 8.

Figure 20:
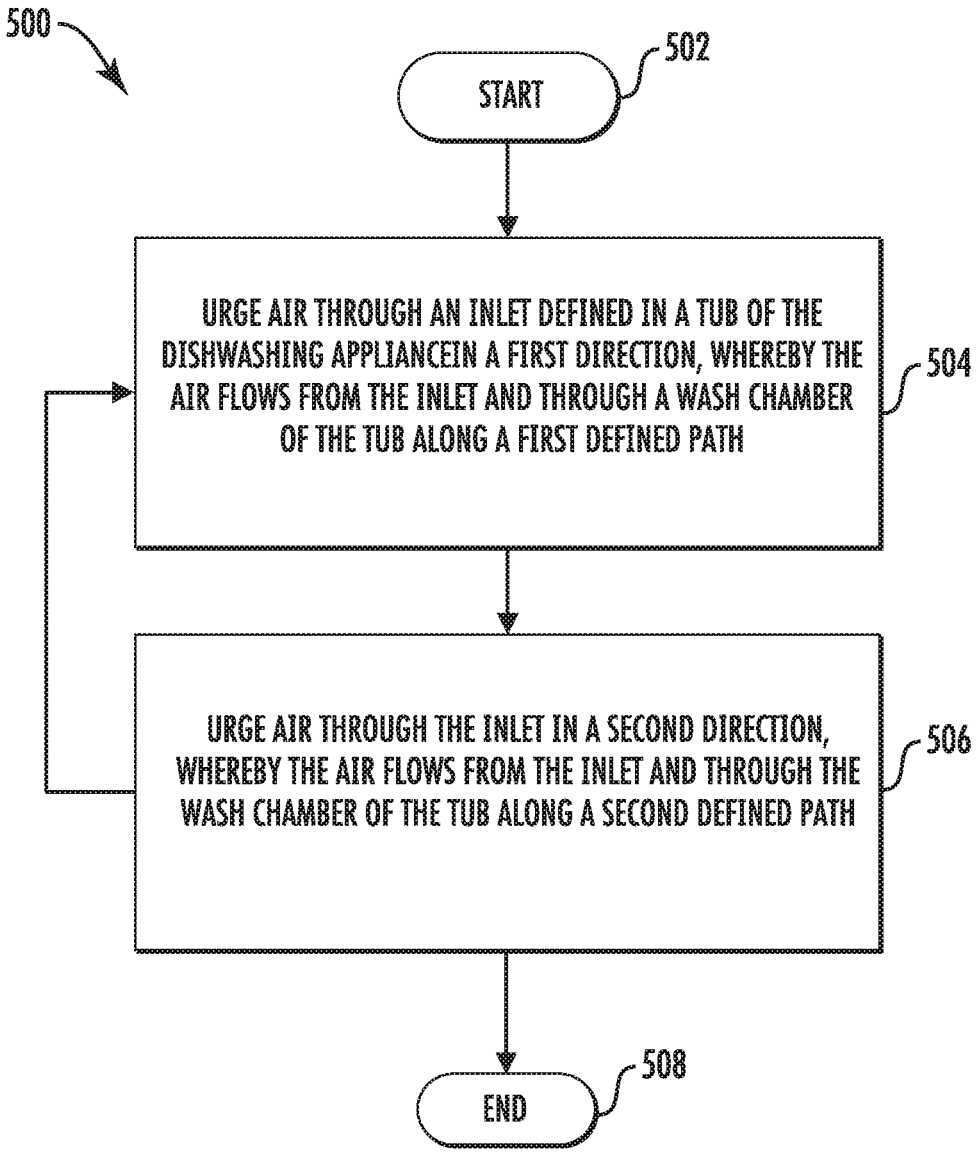
FIG. 20 provides a diagram illustrating an exemplary method of drying articles in a dishwasher according to one or more embodiments of the present disclosure.

Embodiments of the present disclosure also include methods of drying articles, e.g., dishes, in a dishwashing appliance, such as the method 500 illustrated in FIG. 20. As illustrated in FIG. 20, the method 500 may begin at a start 502, such as in response to a command or instruction from the controller 137 and/or interface 136 (FIGS. 1 and 2), which may be part of an overall wash and dry operation of the dishwashing appliance 100 and/or may be a standalone drying cycle. The method 500 may include a step 504 of urging air 400 through an inlet 166 defined in a tub 104 of the dishwashing appliance 100 in a first direction, whereby the air 400 flows from the inlet 166 and through a wash chamber 106 of the tub 104 along a first defined path, for example, the first defined path illustrated in FIG. 3 or FIG. 5.

The method 500 may further include a step 506 of urging the air 400 through the inlet 166 defined in the tub 104 of the dishwashing appliance 100 in a second direction, whereby the air 400 flows from the inlet 166 and through the wash chamber 106 of the tub 104 along a second defined path, for example, the second defined path illustrated in FIG. 4 or FIG. 6. After the step 506, the method 500 may return to the step 504 and alternate between urging the air 400 in the first and second directions through one or more subsequent iterations, and/or may proceed to an end 508 of the drying cycle or operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

an inlet defined in the tub and providing air flow into the wash chamber;

an air handler configured to selectively urge air through the inlet in one of a first direction and a second direction different from the first direction;

a diverter disk proximate the inlet downstream of the air handler and upstream of the wash chamber, the diverter disk defining an axial direction, the diverter disk movable along the axial direction between a first position and a second position, wherein the diverter disk is configured to move from the second position to the first position when the air handler urges air through the inlet in the first direction, and to move from the first position to the second position when the air handler urges air through the inlet in the second direction, and wherein the diverter disk translates along the axial direction and rotates about the axial direction when the diverter disk moves between the first position and the second position;

wherein the air flows from the inlet and through the wash chamber of the tub along a first defined path when the air handler urges the air in the first direction, and wherein the air flows from the inlet and through the wash chamber of the tub along a second defined path when the air handler urges the air in the second direction.

2. The dishwashing appliance of claim 1, further comprising a rack assembly configured to locate articles for washing within the wash chamber, wherein the air impinges on a first side of articles located in the rack assembly when the air flows along the first defined path, and wherein the air impinges on a second side of articles located in the rack assembly when the air flows along the second defined path.

3. The dishwashing appliance of claim 1, wherein the air handler is an axial fan configured to selectively rotate in a first direction and a second direction, wherein the axial fan urges the air in the first direction when the axial fan rotates in the first direction and urges the air in the second direction when the axial fan rotates in the second direction.

4. The dishwashing appliance of claim 1, wherein the air handler comprises a first fan configured to urge the air in the first direction and a second fan configured to urge the air in the second direction.

5. The dishwashing appliance of claim 1, further comprising an outlet in the tub, the outlet providing fluid communication from the tub to an ambient environment external to the dishwashing appliance, wherein the first defined path extends from the inlet to the outlet and the second defined path extends from the outlet to the inlet.

6. The dishwashing appliance of claim 1, further comprising a recirculation conduit in fluid communication with the tub, wherein the first defined path extends from the inlet to the recirculation conduit and the second defined path extends from recirculation conduit to the inlet.

7. The dishwashing appliance of claim 6, further comprising a dehumidifier in the recirculation conduit.

8. The dishwashing appliance of claim 1, wherein the diverter disk comprises an aperture, and wherein the air handler is in fluid communication with the wash chamber through the aperture in the diverter disk.

9. A method of drying articles in a dishwashing appliance, the method comprising:

urging air through an inlet defined in a tub of the dishwashing appliance in a first direction, whereby the air flows from the inlet and through a wash chamber of the tub along a first defined path;

urging air through the inlet defined in the tub of the dishwashing appliance in a second direction, whereby the air flows from the inlet and through the wash chamber of the tub along a second defined path;

moving a diverter disk from a first position to a second position when urging the air in the first direction; and moving the diverter disk from the second position to the first position when urging the air in the second direction;

wherein the diverter disk defines an axial direction, wherein the diverter disk translates along the axial direction and rotates about the axial direction during the step of moving the diverter disk from the first position to the second position and during the step of moving the diverter disk from the second position to the first position.

10. The method of claim 9, further comprising impinging the air on a first side of articles located in a rack assembly within the wash chamber when urging the air along the first defined path, and impinging the air on a second side of the articles located in the rack assembly of the wash chamber, the second side opposing the first side, when urging the air along the second defined path.

11. The method of claim 9, wherein the step of urging the air in the first direction comprises rotating a fan in a first direction and the step of urging the air in the second direction comprises rotating the fan in a second direction.

12. The method of claim 9, wherein the step of urging the air in the first direction comprises activating a first fan and the step of urging the air in the second direction comprises activating a second fan.

13. The method of claim 9, wherein the step of urging the air in the first direction comprises urging the air from the inlet to an outlet in fluid communication with an ambient environment external to the dishwashing appliance, and the step of urging the air in the second direction comprises urging the air from the outlet to the inlet.

14. The method of claim 9, wherein the step of urging the air in the first direction comprises urging the air from the inlet to a recirculation conduit in fluid communication with the tub, and the step of urging the air in the second direction comprises urging the air from the recirculation conduit to the inlet.

15. The method of claim 14, further comprising flowing the air across a dehumidifier in the recirculation conduit.

16. The method of claim 9, wherein urging air through the inlet in the first direction causes the diverter disk to move from the first position to the second position, and wherein urging air through the inlet in the second direction causes the diverter disk to move from the second position to the first position.

17. The method of claim 9, wherein urging air through the inlet comprises urging the air through an aperture in the diverter disk.

* * * * *